United States Patent [19]

Tolley et al.

[11] 4,174,274

[45] Nov. 13, 1979

[54] SEPARATION OF RUTILE FROM ILMENITE

[75] Inventors: William K. Tolley; Beckay J. Nelson, both of Arlington Heights, Ill.

[73] Assignee: UOP Inc., Des Plaines, Ill.

[21] Appl. No.: 868,966

[22] Filed: Jan. 12, 1978

[51] Int. Cl.[2] ..... B03D 1/02

[52] U.S. Cl. ..... 209/166; 209/9

[58] Field of Search ..... 209/3, 9, 166, 167; 423/69, 80

[56] References Cited

U.S. PATENT DOCUMENTS

| | | | |
|---|---|---|---|
| 3,353,668 | 11/1967 | Duke | 209/166 X |
| 3,655,038 | 4/1972 | Mercade | 209/166 X |
| 3,951,786 | 4/1976 | Petrovich | 209/166 |
| 3,961,940 | 6/1976 | Fukushima | 209/3 X |

FOREIGN PATENT DOCUMENTS

| | | | |
|---|---|---|---|
| 479072 | 12/1951 | Canada | 209/166 |
| 442642 | 12/1919 | Fed. Rep. of Germany | 209/166 |
| 1352306 | 5/1974 | United Kingdom | 423/69 |

*Primary Examiner*—Robert Halper

*Attorney, Agent, or Firm*—James R. Hoatson, Jr.; Raymond H. Nelson; William H. Page, II

[57] ABSTRACT

Rutile may be separated from ilmenite or ilmenite ores by agitating a mixture of ilmenite and rutile in particle form in an aqueous solution containing a collection agent to which hydrogen peroxide has been added. The slurry in agitated form is treated with air to produce a froth. The ilmenite particles will attach themselves to the air bubbles in the froth and may be skimmed off the surface of the solution, the rutile then being recovered from the solution.

6 Claims, No Drawings

SEPARATION OF RUTILE FROM ILMENITE

This invention relates to a method for separating rutile from ilmenite. More particularly, the invention is concerned with a process for separating rutile from ilmenite utilizing a froth flotation process.

Titanium in metallic form or as a compound is an important element in the chemical series. For example, titanium dioxide is utilized in paint pigments, in white rubbers and plastics, floor coverings, glassware and ceramics, printing inks, as an opacifying agent in papers, etc. Other titanium compounds are used in electronics, as fire retardants, waterproofing agents, etc. The metal may be used as such, or in alloy form as structural material in aircraft, in jet engines, marine equipment, textile machinery, surgical instruments, orthopedic appliances, sporting equipment, food handling equipment, etc. When attempting to separate titanium dioxide from impurities such as ilmenite, iron oxides, etc., which are also contained in the titanium bearing source such as ores, the separation is relatively difficult to effect whereby relatively low yields of titanium dioxide in a pure form are obtained. However, it has now been discovered that the separation of rutile, which is titanium dioxide, from ilmenite or ilmenite ores which is a compound of ferrous oxide and titanium dioxide, may be accomplished in a relatively simple manner by utilizing the process hereinafter described in greater detail. The advantage of utilizing the process of the present invention is found in the fact that it is possible to obtain a high degree of rutile recovery using relatively low grade ilmenite ore as the starting material.

It is therefore an object of this invention to provide an improved process for the production of titanium dioxide values. A further object of this invention is to provide a beneficiation process for obtaining high yields of titanium dioxide values from titanium bearing sources.

In one aspect an embodiment of this invention resides in a method for effecting the separation of ilmenite from rutile which comprises agitating a mixture of ilmenite and rutile particles in an aqueous hydrogen peroxide solution containing a collection agent, sparging said solution with air, skimming off the resultant froth containing the ilmenite, and recovering the desired rutile.

A specific embodiment of this invention is found in a method for effecting the separation of ilmenite from rutile which comprises agitating a mixture of ilmenite and rutile particles which possess a size of from about −50 to about −400 mesh in an aqueous hydrogen peroxide solution containing oleic acid, said hydrogen peroxide being present in an amount in a range of from about 0.01 to about 1.0 millimoles (0.34–34 mg) of hydrogen peroxide per liter of water, sparging said solution with air, skimming off the resultant froth containing ilmenite, and recovering the desired rutile.

Other objects and embodiments will be found in the following further detailed description of the present invention.

As hereinbefore set forth the present invention is concerned with an improvement in a process or method for effecting the separation of rutile from ilmenite. In one method of effecting the recovery of titanium values from a titanium bearing source such as ilmenite, which is a compound of ferrous oxide and titanium dioxide, the ilmenite, after having been crushed to a desired mesh value may be subjected to an oxidation step by being contacted with water at ambient temperature or by being contacted with an oxidizing gas such as oxygen or air at an elevated temperature. The oxidized metal bearing source such as ilmenite is then divided into two portions. One portion is then subjected to a reductive roast in the presence of a reductant which may comprise hydrogen, carbon monoxide or mixtures thereof and after having undergone the reductive roast for a period of time sufficient to effect a reduction of the metal bearing source at temperatures ranging from about 600° to about 1000° C. the metal bearing source is then subjected to an aqueous hydrogen chloride leach. This leach is also effected at elevated temperatures usually in the range of from about 80° C. to about 100° C. for a period of time ranging from about 0.25 to about 1 hour or more in duration. Upon completion of the leaching step the leached slurry is then subjected to precipitation by treating the slurry with the portion of the oxidized ore which was separated from the total portion of the ore and not subjected to the reductive roast. The addition of the oxidized source to the leach solution is also effected at elevated temperatures ranging from about 75° to about 105° C. while subjecting the mixture to agitation or stirring for a period of time which may range from about 2 minutes up to about 1 hour or more in duration.

At this point in the process, the ilmenite and rutile will both be present in particle sizes which may range from about −50 to about −400 mesh. It has now been discovered that the rutile may be separated from the ilmenite by utilizing a difference in the Zeta potential of the two metal bearing sources. The Zeta potential relates to the surface charge on the ore particles. The separation in which the Zeta potential of ilmenite has a major effect exerted upon it while utilizing only a minor effect on the Zeta potential of rutile resides in treating the mixture of the two metal bearing sources in a froth flotation step in the presence of hydrogen peroxide. For example, when a mixture of ilmenite and rutile is subjected to froth flotation in a normal manner, the Zeta potential of the two ores will exhibit a relatively small differential. That is, when an electrical potential is applied to the solution containing the two ores most of the particles will be attracted in the same direction due to a relatively small differential in polarity. In contradistinction to this, it has now been discovered that the addition of relatively small amounts of hydrogen peroxide to the solution will alter the polarity to such a degree that it will be possible to effectively separate the ilmenite from the rutile.

The separation of the ilmenite from the rutile is effected by suspending the discrete particles of rutile and ilmenite in an aqueous solution which contains from about 0.01 to about 1.0 millimoles, that is, 0.34 to 34 mg., of hydrogen peroxide per liter of water. In addition to the hydrogen peroxide the solution will also contain a collection agent which may comprise an ether amine which contains from about 5 to about 8 carbon atoms in the ether chain and from 1 to about 5 carbon atoms in the amine moiety or a fatty acid. As an example of the ether amine collection agent, it is possible to use an ether amine which is sold under the tradename Arosurf MG-70A3 by the Ashland Chemical Company. Examples of fatty acids which may be used as collection agents will include the saturated fatty acids such as caprylic acid, pelargonic acid, capric acid, lauric acid, myristic acid, palmitic acid, margaric acid, stearic acid, etc., or unsaturated acids such as oleic acid, linoleic acid, etc. The solution containing the ilmenite and rutile particles is agitated vigorously for a predetermined period of time in order that the reagents which are present in the solution are adsorbed onto the surface of the minerals. Following this, the slurry is then sparged with air or treated in any other manner which will result in the production of air bubbles. Due to the change in the Zeta potential the collection reagent will selectively adsorb onto the ilmenite particles, which will attach themselves to the bubbles and may then, by utilizing a skimming operation, skim off the bubbles from the surface of the flotation cell. The concentrated rutile which remains is in the slurry and may be recovered from the solution by conventional methods such as decantation, filtration, etc., after removal of the ilmenite in the froth. Thereafter the recovered rutile may be treated in any suitable manner known in the art to recover the desired titanium dioxide in purified form.

In addition to the hydrogen peroxide which is present in the aqueous solution and the collection agent, it is also contemplated within the scope of this invention that the separation of the ilmenite from the rutile be effected in a controlled pH medium. In the preferred embodiment of the invention the pH of the solution is maintained in a range of from about 4 to about 7, the adjustment of the pH within this range being effected by the addition of an acid or alkali such as hydrochloric acid or sodium hydroxide, the choice of control agents being determined by the pH of the solution prior to treatment with the hydrogen peroxide.

Although the hereinbefore set forth discussion has been concerned with the treatment of rutile obtained from treatment of the leach solution, it is also contemplated within the scope of this invention that the separation process of the present invention may be effected as a preliminary step. This is due to the fact that the raw ilmenite ore from Australia, India, Norway, Canada, United States, etc., often contains rutile. Therefore, the rutile may be separated from the ilmenite ore prior to treating the ilmenite ore by the oxidation, reduction, leaching, etc., steps which have been set forth or other processes where separation of ilmenite and rutile would be desirable. After treating the raw ilmenite ore by suppressing the flotation of rutile in the froth flotation process of the present invention whereby said raw ilmenite ore is ground to the desired particle size and thereafter suspended in a solution containing hydrogen peroxide and the collecting agent, the slurry is agitated and sparged with air, following which the ilmenite particles which have attached themselves selectivelyto the air bubbles which are produced by the air treatment and are thereafter skimmed off, the ilmenite particles which have been removed may be recovered and treated by oxidation, reduction of a portion thereof, leaching, etc., or other methods known to the art.

The following examples are given for the purposes of illustrating the process of this invention. However, it is to be understood that the examples merely illustrate the process and that said process is not intended to be limited thereby.

EXAMPLE I

In this example a natural ilmenite ore was ground to about −28 mesh. This ore was subjected to a reductive roast in a reducing atmosphere comprising a mixture of hydrogen and carbon monoxide at a temperature of about 750° C. The ilmenite which was reductively roasted was then subjected to an aqueous hydrogen chloride leach and treated to recover the dissolved titanium by reaction with iron oxide. Rutile produced by this procedure was mixed with an equal weight of −65 mesh natural ilmenite and 1.5 grams sample of the ilmenite-rutile mixture was admixed with 100 cc of water and stirred vigorously for a period of 1 minute. The agitation was discontinued and after the bulk of the solids had been allowed to settle the solution was decanted to remove the slimes. The remaining solids were then admixed with 100 cc of water which contained 50 mg/liter of an ether-amine collector agent known in the trade as Arosurf MG-70A3. In addition the water contained 3.4 mg of hydrogen peroxide. The pH of the slurry was adjusted to 7 by using dilute sodium hydroxide solution, said slurry being conditioned at this pH by stirring vigorously for a period of 5 minutes. Following this, the slurry was then transferred to a Hallimond tube and sparged with air for a period of 3 minutes using a charge of 50 ml/min. of air. At the end of this time, the froth which resulted was removed and the float and sink products were filtered, dried, and weighed. It was determined that 78% of the rutile was recovered in the sink product.

In contradistinction to this when the above experiment was repeated in the absence of any hydrogen peroxide, only 35% of the rutile was recovered in the sink product.

EXAMPLE II

In this example 1 gram of a rutile-ilmenite mixture which was prepared in a manner similar to that set forth in Example I above was treated with 100 cc of water while maintaining the temperature at 40° C. A sufficient amount of hydrogen peroxide was added to the water to reach a concentration of $10^{-5}$ molar. Following this 50 mg/liter of oleic acid which acted as a collection agent was added and the pH was adjusted to a value of 6 using a dilute sodium hydroxide solution. The slurry was conditioned with vigorous stirring for a period of 5 minutes and thereafter was transferred to a Hallimond tube and sparged with air for a period of 3 minutes using a charge of 50 ml/min. of air. Separation of the froth from the liquid followed by filtering and drying disclosed that approximately 90% of the rutile was recovered in the sink product.

In contradistinction of this, when the test was repeated by omitting the hydrogen peroxide and having only oleic acid as a collector agent present the result was that there was no flotation of either the rutile or the ilmenite, hence, no separation thereof.

It is therefore readily apparent from the above examples that when utilizing hydrogen peroxide in a froth flotation separation process it is possible to obtain a sharp demarcation between ilmenite and rutile with the concurrent ease of separation and recovery of the latter.

We claim as our invention:

1. A method for effecting the separation of ilmenite from rutile which comprises agitating a mixture of ilmenite and rutile particles in an aqueous hydrogen peroxide solution containing a collection agent selected from the group consisting of a fatty acid and an ether amine, sparging said solution with air, skimming off the resultant froth containing the ilmenite, and recovering the desired rutile.

2. The method as set forth in claim 1 in which said fatty acid is oleic acid.

3. The method as set forth in claim 1 in which said fatty acid is stearic acid.

4. The method as set forth in claim 1 in which said hydrogen peroxide is present in an amount in the range of from about 0.01 to about 1.0 millimoles of hydrogen peroxide per liter of water.

5. The method as set forth in claim 1 in which said particles are in a size of from about −50 to about −400 mesh.

6. The method as set forth in claim 1 in which the pH of said solution is maintained in a range of from about 4 to about 7.

* * * * *